United States Patent [19]

Schuster

[11] Patent Number: 4,811,894

[45] Date of Patent: Mar. 14, 1989

[54] SLEEVE-TYPE CARRIER HANDLE

[75] Inventor: Richard L. Schuster, Monroe, La.

[73] Assignee: Manville Corporation, Denver, Colo.

[21] Appl. No.: 249,230

[22] Filed: Sep. 23, 1988

Related U.S. Application Data

[63] Continuation of Ser. No. 60,593, Jun. 11, 1987, abandoned.

[51] Int. Cl.[4] ..... B65D 5/46

[52] U.S. Cl. ..... 229/52 B; 206/141

[58] Field of Search ..... 229/40, 52 B; 206/141, 206/427

[56] References Cited

U.S. PATENT DOCUMENTS

| | | | |
|---|---|---|---|
| 3,112,856 | 12/1963 | MacIntosh et al. | 229/52 B |
| 4,405,078 | 9/1983 | Dutcher et al. | 229/52 B |
| 4,558,816 | 12/1985 | Wood | 206/427 |
| 4,684,059 | 8/1987 | Rusnock | 206/427 |

FOREIGN PATENT DOCUMENTS

| | | | |
|---|---|---|---|
| 712905 | 7/1965 | Canada | 229/52 B |
| 1602857 | 11/1981 | United Kingdom | 229/52 B |

*Primary Examiner*—Stephen Marcus
*Assistant Examiner*—Gary E. Elkins
*Attorney, Agent, or Firm*—John D. Lister

[57] ABSTRACT

A sleeve-type beverage can carrier with a handle opening in the top panel extending transversely of the folds connecting the top panel and the side panels. Tabs foldably connected to the transversely extending edges of the handle opening meet at the midpoint of the top panel, and slits extend from one of the handle opening edges through the folds and into the upper portions of the side panels. When the carrier is lifted, the top panel between the slits and the end panel nearest to the handle edge being grasped is caused to bow upwardly, and the lifting stresses are distributed through the top and side panels to prevent tearing.

6 Claims, 3 Drawing Sheets

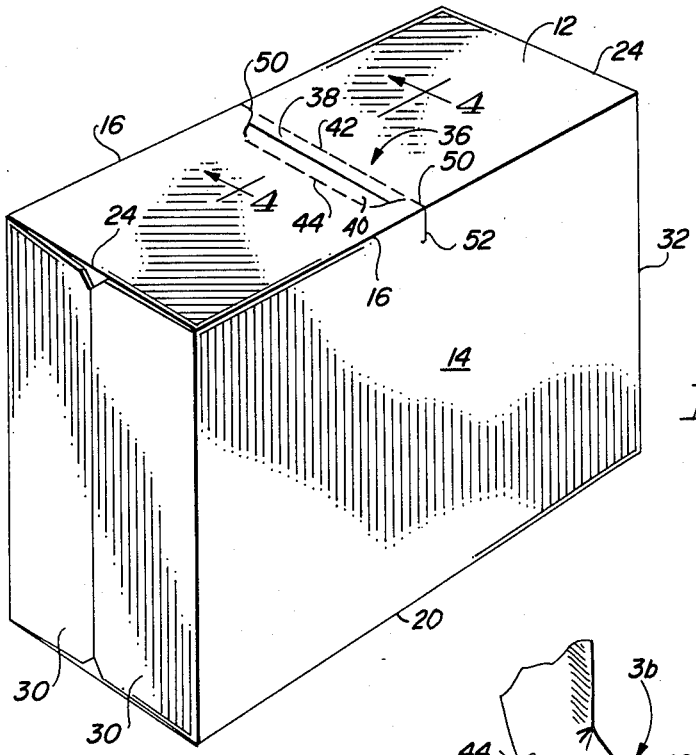
FIG. 2
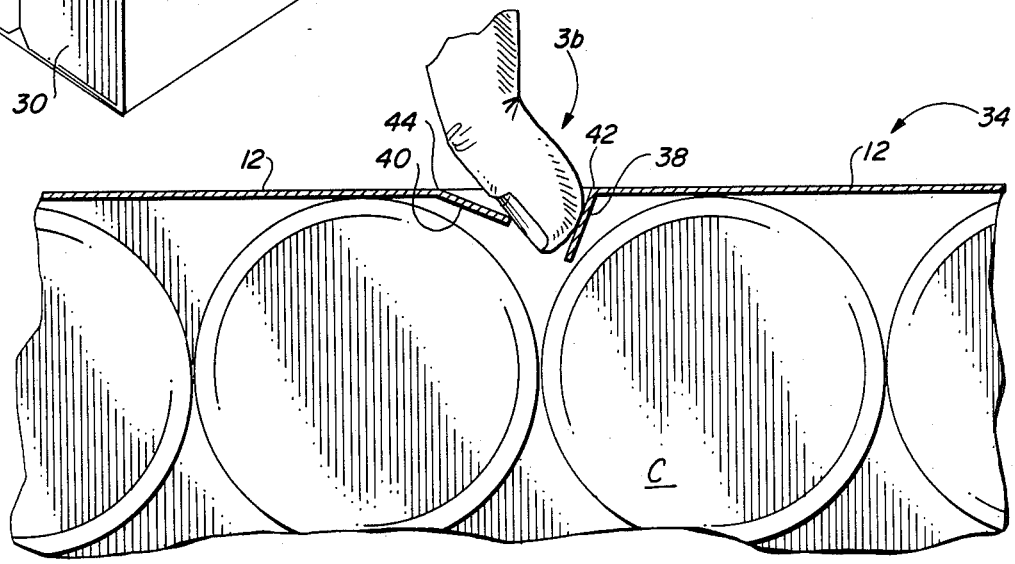
FIG. 4
FIG. 5
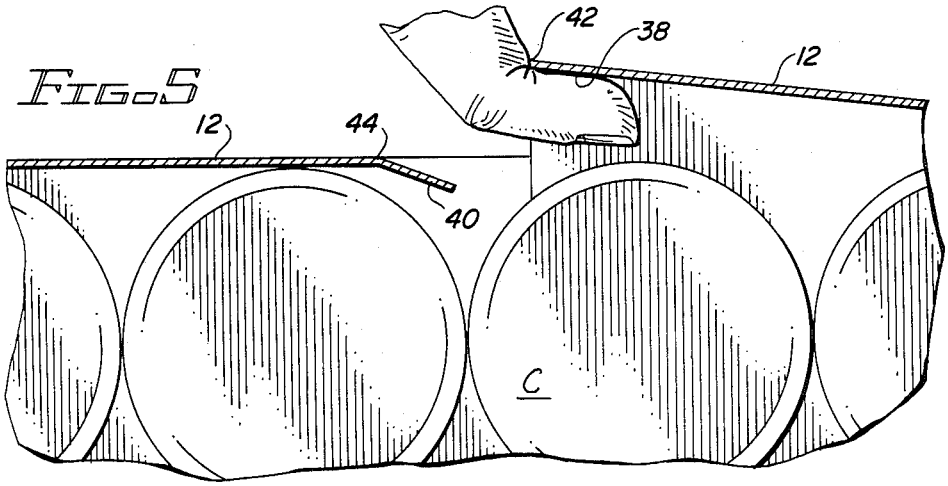

SLEEVE-TYPE CARRIER HANDLE

This is a continuation of application Ser. No. 07/060,593, filed June 11, 1987 now abandoned.

FIELD OF THE INVENTION

This invention relates to a sleeve-type article carrier, and more particularly to a sleeve-type article carrier having an improved handle.

BACKGROUND OF THE INVENTION

Sleeve-type carriers used to package beverage cans are typically formed from paperboard blanks which are opened into sleeve form in order to receive the cans, after which the end panels of the blanks are folded and glued together. The resulting package completely encloses the cans and has a handle incorporated in the top panel to allow a user to more readily lift and carry the package.

Many different handle designs have been used in sleeve-type carriers over the years, the most common probably being the suitcase type of handle. This comprises two handle openings in the top panel extending lengthwise of the carrier and being spaced from each other so that the top panel portion between them forms a strap. The carrier is lifted by inserting the fingers in one of the openings and lifting up on the strap portion. One problem with this design is that the edges of the strap are often uncomfortable to the hand, particularly if the package is carried for any length of time. Another problem is that the concentration of lifting stresses at the ends of the strap has necessitated the use of relatively thick paperboard to prevent tearing at these locations.

To overcome these problems it has been suggested to employ a transversely extending handle instead. Such a handle comprises a transverse opening in the top panel of the carrier through which the fingers are inserted. The user then lifts up against the underside of the top panel to lift and carry the package. Although this arrangement makes the lifting and carrying process more comfortable, packages still need some provision to distribute the lifting stresses in order to prevent tearing. If no provision is made, such as in the handle arrangement disclosed in U.S. Pat. No. 2,718,301, issued to F. D. Palmer, the package is susceptible to tearing at the ends of the handle opening. Since the only way to prevent tearing in a design such a Palmer's is to use relatively thick paperboard, the production costs increase as a result.

To combat the tendency to tear, the carrier disclosed in U.S. Pat. No. 4,558,816, issued to P. J. Wood, incorporates a centrally located slit that extends into the side panels of the carrier and also contains a series of fold lines connected to the slit. This arrangement is for the purpose of distributing the lifting stresses generated when the package is lifted by its handle. Even this design, however, permits more concentration of lifting stresses adjacent the ends of the transverse slit than desired, forcing relatively rigid design parameters to be followed and causing the top panel to be pulled up too abruptly when lifted.

It would be desirable to provide a carrier having a transverse handle design which resists the tendency to tear at the ends of the handle and which permits a reduction in the caliper of the paperboard without resulting in an excessively flexible handle structure.

BRIEF SUMMARY OF THE INVENTION

This invention provides an improved handle design which overcomes the problems discussed above. The top panel contains a handle opening comprising two spaced edges extending transversely of the folds connecting the side panels to the top panel. Each spaced edge of the handle opening is foldably connected to a flap or tab covering a portion of the handle opening, and one of the spaced edges is located between the midpoint of the top panel and one of the end panels. The top panel further contains slits extending from the ends of the latter mentioned spaced edge, through the folds connecting the side panels to the top panel, and terminating in the upper portions of the side panels.

By this arrangement the slits are offset from the midpoint of the top panel but are still close enough to the midpoint so that the handle opening is generally centrally located. When the carrier is lifted the weight is thus substantially evenly distributed on either side of the handle opening, but the offset slit arrangement acts to decrease the lifting stresses, thus reducing the tendency to tear and permitting the use of thinner paperboard.

These design features can readily be implemented in the standard type of sleeve-type carrier production blank, requiring only minor changes to the blank forming die to provide for new slit and fold lines.

Other features and aspects of the invention will be made clear, as well as the various benefits of the invention, in the more detailed description of the invention which follows.

BRIEF DESCRIPTION OF THE DRAWINGS

FIG. 2 is a pictorial representation of a carrier formed from the blank of FIG. 1;

FIG. 4 is an enlarged partial sectional view taken along the length of the carrier through the handle portion, along line 4—4 of FIG. 2, showing the fingers of a user pushing down the tabs covering the handle opening;

FIG. 5 is a view similar to that of FIG. 4, but showing the fingers lifting up on the package after the tab adjacent the fingers has been folded back;

DESCRIPTION OF THE INVENTION

Figure 1:
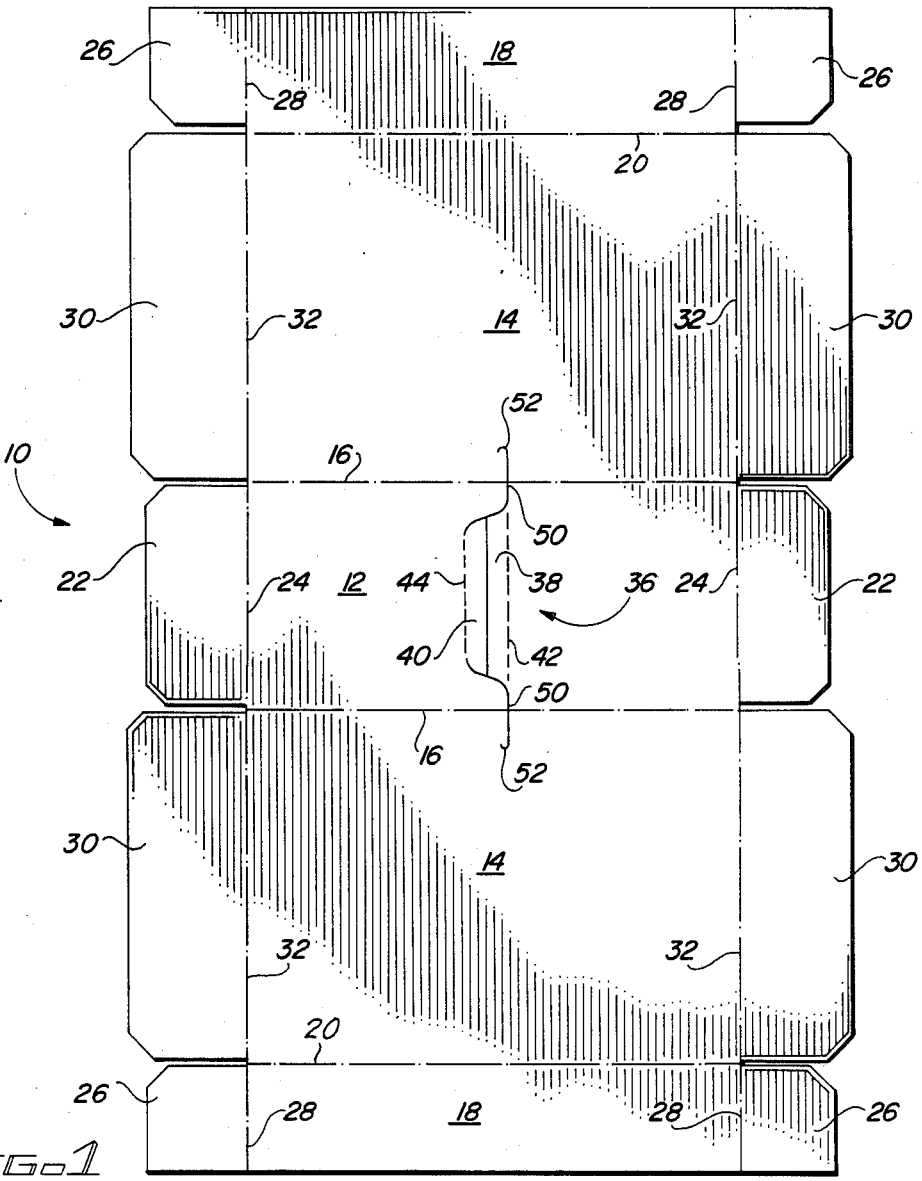
FIG. 1 is a plan view of a production blank used to form the carrier of the present invention.

Referring to FIG. 1, a production blank 10 has a central section 12 connected to intermediate sections 14 by score lines 16. End sections 18 are connected to the intermediate sections 14 by score lines 20. When the blank is folded about the score lines 16, the central section 12 becomes the top panel of the carrier and the intermediate sections 14 become the side panels of the carrier. The end sections are dimensioned so that upon being folded about the score lines 20, they overlap each other. Upon being glued in the overlapping region, the attached end sections become the bottom panel of the carrier.

Dust flaps 22 are connected to the central section 12 by score lines 24, and dust flaps 26 are connected to the end sections 18 by score lines 28. End flaps 30 are connected to the intermediate sections 14 by score lines 32 which are aligned with and form a continuation of the score lines 24 and 28. In forming the carrier, the dust flaps 22 and 26 are folded toward each other after the blank has been folded about score lines 16 and 20. Then the end flaps 30 are folded toward each other and adhered by glue to the dust flaps to form the end panels of the carrier.

The resulting carrier 34 is shown in FIG. 2, wherein the top panel 12 corresponds to the central section 12 of the blank 10, the side panels 14 correspond to the intermediate sections 14, and the end panel is formed from end flaps 30. The folds 16, 20, 24 and 32 correspond to score lines 16, 20, 24 and 32 of the blank 10. The bottom panel corresponding to the end sections 18 is not visible in this view.

Figure 3:
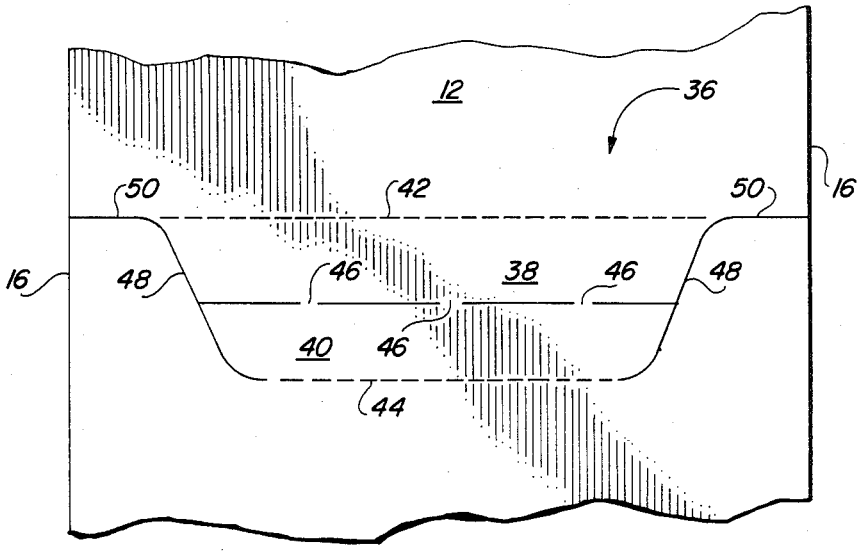
FIG. 3 is an enlarged partial plan view of the handle portion of the top panel of the carrier of FIG. 2.

Referring to FIGS. 1, 2 and 3, the top panel is provided with a handle opening 36. Prior to the carrier being lifted by the handle, the opening is covered by flaps or tabs 38 and 40 which are joined to the top panel by fold lines 42 and 44, respectively. As shown best in FIG. 3, the adjacent edges of the tabs 38 and 40 are connected by spaced narrow segments of paperboard 46 which are adapted to be readily broken by downward pressure of the fingers of a user so as to fold the tabs downwardly into the interior of the carrier about their fold lines 42 and 44. The handle opening is thus preferably covered by the combined tabs to prevent entry of dust and dirt into the carrier.

Still referring to FIGS. 1, 2 and 3, and particularly to FIG. 3, the ends of the fold lines 42 and 44 are connected by slits 48 extending transversely of the handle opening 36. The handle opening is thus defined by the fold lines 42 and 44 and the slits 48. Extending from the ends of the fold line 42 and connected to the adjacent ends of the slits 48 are slits 50. The slits 50 extend through the folds 16 and terminate in the upper portions of the side panels 14. If desired, the ends of the slits 50 may terminate in a small arcuate portion, as indicated at 52 in FIGS. 1 and 2, to resist any tendency of the side panels to tear at the ends of the slits 50 upon lifting and carrying the carrier.

As shown in FIG. 1, the adjacent edges of the flaps or tabs 38 and 40 are substantially aligned with the transverse centerline of the carrier. In other words, the adjacent edges of the tabs pass through the midpoint of the top panel 12. Thus the edge 42 of the handle opening and the slits 50 extending therefrom are offset from the midpoint of the top panel, as is the edge 44 of the handle opening.

Referring to FIG. 4, the interior of the carrier 34 is shown as containing beverage cans C. Since the handle opening 36 is located centrally of the carrier, it can be understood that the carrier should be designed so that the row of cans immediately beneath the top panel 12 contains an even number of cans. In this way the handle opening is assured of being located between cans to permit the fingers of a user to penetrate into the space between adjacent cans. For example, the carrier of FIG. 4 could be designated to hold twelve cans arranged in three rows of four cans each, or twenty-four cans arranged in four rows of six cans each. The two cans shown immediately subjacent the handle opening 36 would thus be the two innermost cans in the top row immediately beneath the top panel 12.

Still referring to FIG. 4, the fingers of a user have pressed down against the tabs 38 and 40 sufficiently to break the weak connection between them, resulting in the tab 38 being folded down about its fold line 42 by the tips of the fingers. At the same time the backs of the fingers have folded the tab 40 down about its fold line 44. As can be seen, because of the offset location of the fold line 42 the tab 38 would strike the nearest can C as the tab is being pivoted about its fold line. At about this point, however, the user lifts upward while at the same time continuing the tab folding action. This produces the result shown in FIG. 5, wherein the top panel adjacent the fold line 42 has been raised and the tab 38, in the space created by the raised panel, has been folded back under the panel 12. The fingers are cushioned by the double thickness of paperboard created by the top panel 12 and the tab 38. The tab 40 simply remains bent down out of the plane of the top panel.

Figure 6:
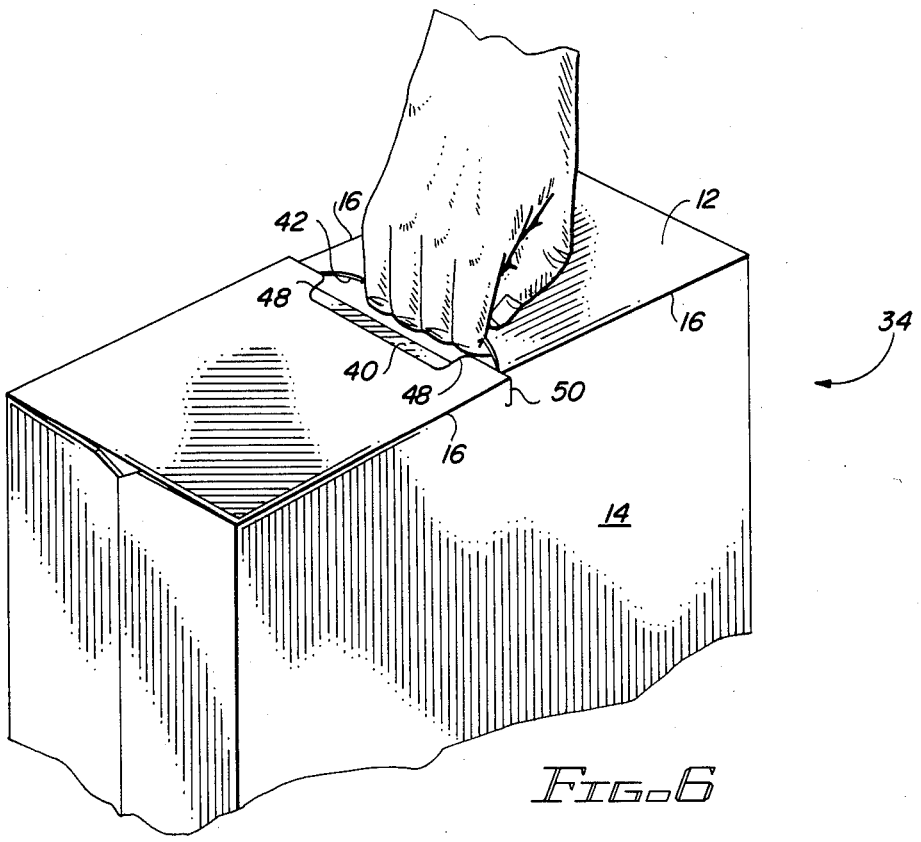
FIG. 6 is a pictorial representation of the upper portion of the carrier of the present invention, showing the distortion of the handle portion and the upper portions of the side panels when the carrier is lifted along one of the edges of the handle opening.

As illustrated in FIG. 6, when the carrier is lifted in the manner shown in FIG. 5, the lifting stresses cause the folds 16 in the portion of the top panel being upwardly bowed to move inwardly toward each other. This inward movement is made possible by the slits 50 in the side panels 14. Stresses caused by lifting are thus uniformly distributed into the side panels 14 and the folds 16 as evidenced by the upper panel 12 being bowed upwardly in a smooth and uniform manner between the slits 50 and the end panel nearest to the edge 42.

Figure 7:
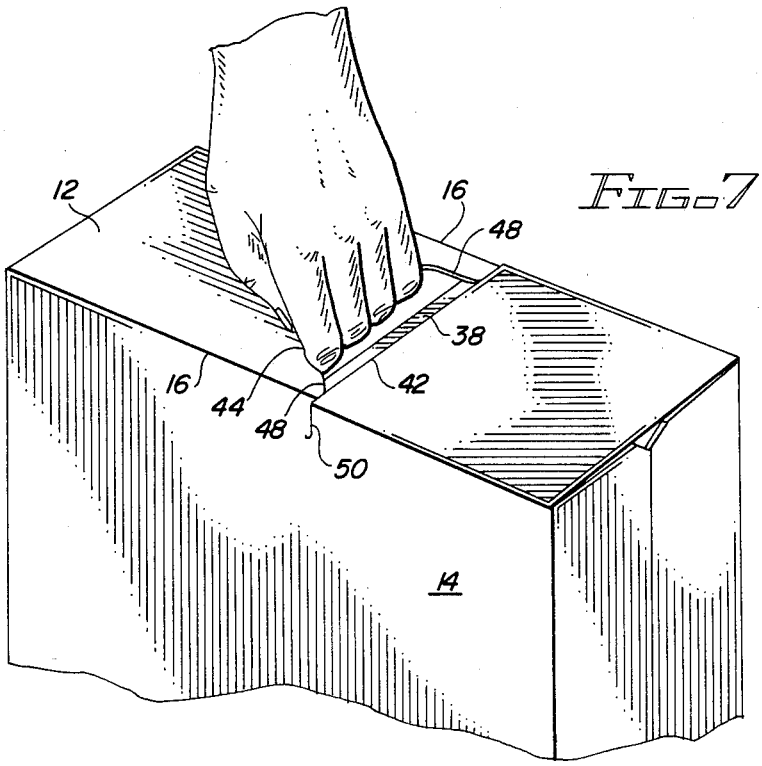
FIG. 7 is a pictorial representation similar to that of FIG. 6, but showing the carrier being lifted along the other edge of the handle opening.

Although it is easier to lift the carrier from the edge 42 than from the edge 44, because the distance from the slits 50 to the nearest end panel is less than the distance from the slits 50 to the opposite end panel, it is of course possible to lift the carrier from the edge 44 as well. In such case, as shown in FIG. 7, the fingers of the user would engage the edge 44, and the folds 16 between the slits 50 and the end panel nearest the edge 44 would be drawn toward each other by the stresses of lifting. In a manner similar to the bowing of the top panel in the example described above, the top panel 12 between the slits 50 and the end panel nearest to the edge 44 would be bowed upwardly, and the stresses of lifting would be distributed throughout the side panels 14 and the folds 16. In the event the carrier is lifted at the edge 44, the action of the fingers of the user in first depressing the tabs or flaps 40 and 38, then folding tab 40 back up against the underside of the top panel 12 is the same as explained in connection with FIGS. 4 and 5, except that tab 40 is the main tab involved instead of tab 38. In either case, the smooth uniform upward bowing of the top panel indicates a uniform distribution of the lifting stresses, avoiding a concentration of stresses in any one area or point and thus avoiding tearing of the paperboard.

Note that score lines such as those disclosed in the Wood patent need not be included. The slits extending from the offset edge of the handle opening into the upper portions of the side panels permit the uniform distribution of stresses to a degree which makes the use of stress distribution score lines unnecessary.

Although in the preferred embodiment of the invention the adjacent edges of the handle flaps are centrally located in the top panel, it is possible to incorporate the handle arrangement of the present invention in carriers designed to hold an odd number of containers immediately beneath the top panel. In such a case the adjacent flap edges would be located above the space between the cylindrical side walls of adjacent containers and would therefore be offset from the centerline of the top panel. The normal way of lifting the carrier would thus be by the edge which is closest to the end panel nearest the handle opening.

It should now be obvious, after reading the foregoing description of the preferred embodiment of the invention, that changes to certain specific features of the preferred embodiment can be made without departing from the spirit and scope of the invention.

What is claimed is:

1. A sleeve-type article carrier, comprising:

a top panel;

a bottom panel;

two side panels connected to the top and bottom panels along fold lines;

two end panels between the top, bottom and side panels;

the top panel containing a handle opening comprising two spaced substantially parallel edges extending transversely of the fold lines connecting the side panels to the top panel, the spaced edges having ends located in the top panel;

each spaced edge of the handle opening being foldably connected to a tab covering a portion of the handle opening, the tabs terminating adjacent each other between the spaced edges of the handle opening so that the tabs cover substantially the entire handle opening;

one of the spaced edges of the handle opening being located between a point equidistant from the end panels and one of the end panels; and the top panel containing a slit extending from each end of said one spaced edge, each slit being substantially aligned with said one spaced edge and extending transversely of and through the nearest of the fold lines connecting the side panels to the top panel, each slit terminating in the upper portion of the nearest side panel; and the side panels being devoid of stress relief lines.

2. A sleeve-type article carrier according to claim 1, wherein the other spaced edge of the handle opening is located between a point equidistant from the end panels and the other end panel.

3. A sleeve-type article carrier according to claim 2, wherein the distance between one of the spaced edges and the end panel nearest thereto is substantially equal to the distance between the other spaced edge and the end panel nearest thereto.

4. A sleeve-type article carrier according to claim 1, wherein the adjacent edges of the tabs are weakly connected to each other so as to be readily separated when the fingers of a user press down against one of the tabs.

5. A sleeve-type article carrier according to claim 1, wherein each end of the other spaced edge terminates in the top panel, the top panel containing additional slits extending from the ends of the other spaced edge to the aforesaid transversely extending slits.

6. A sleeve-type article carrier according to claim 5, wherein the additional slits are connected to the transversely extending slits adjacent the ends of the one spaced edge.

* * * * *